US005088376A

United States Patent [19]

Crago et al.

[11] Patent Number: 5,088,376

[45] Date of Patent: Feb. 18, 1992

[54] BASS DRUM ACOUSTIC MUFFLING APPARATUS

[76] Inventors: Scott F. Crago, 12566 Preston Way, Los Angeles, Calif. 90066; Jeff E. Obermeyer, 469 Carroll Ave., Venice, Calif. 90291

[21] Appl. No.: 617,192

[22] Filed: Nov. 23, 1990

[51] Int. Cl.[5] ..... G10D 13/02

[52] U.S. Cl. ..... 84/411 M

[58] Field of Search ..... 84/411 R, 411 M

[56] References Cited

U.S. PATENT DOCUMENTS

| | | | |
|---|---|---|---|
| 4,519,288 | 5/1985 | Aluisi | 84/411 M |
| 4,745,839 | 5/1988 | Peraino | 84/411 M |
| 4,805,514 | 2/1989 | Billings | 84/411 M |

*Primary Examiner*—L. T. Hix
*Assistant Examiner*—Howard B. Blankenship
*Attorney, Agent, or Firm*—William W. Haefliger

[57] ABSTRACT

A bass drum having a curved side wall and two heads, sound muffling means comprising a pillow having longitudinally spaced opposite ends and length between the ends greater than the spacing between the heads; the pillow having lateral width which decreases away from each of the opposite ends toward the center of the pillow; the pillow having a surface which is outwardly and widthwise convex along the pillow length to engage the drum curved side wall of the inner side thereof, as the pillow is endwise compressed by engagement of the pillow opposite ends with the heads.

12 Claims, 2 Drawing Sheets

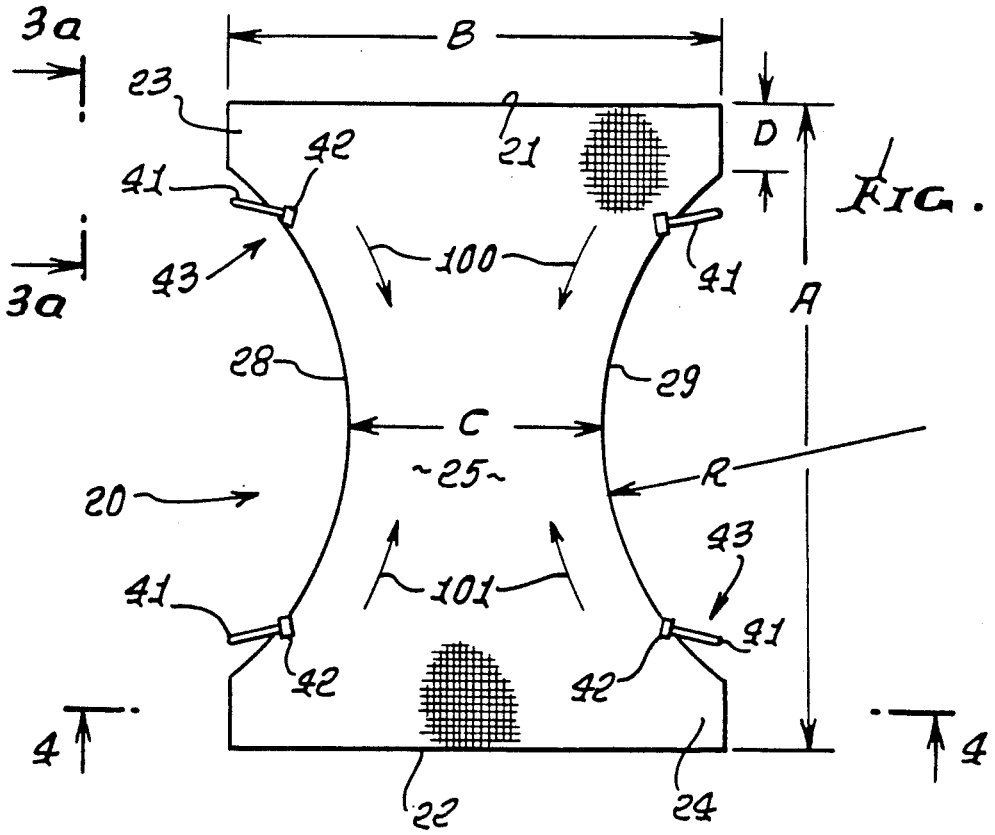
FIG. 3.
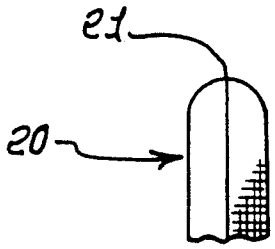
FIG. 3a.
FIG. 4.
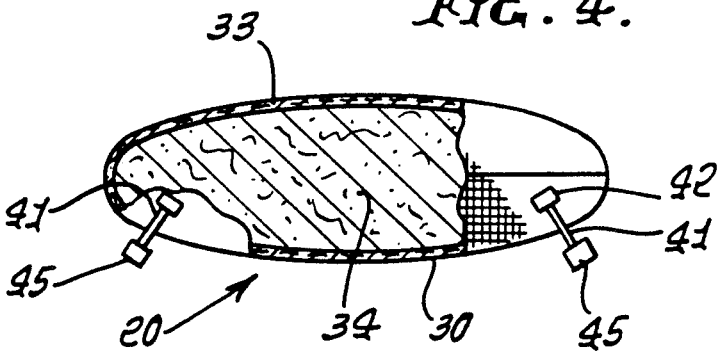

BASS DRUM ACOUSTIC MUFFLING APPARATUS

BACKGROUND OF THE INVENTION

This invention relates generally to acoustic muffling of bass drums; and more particularly concerns the use of improved pillow means within a bass drum to achieve improved muffling.

There is need at the present time for acoustic dampening of bass drum heads, without reducing the natural resonance of the drum. There is also need for dampening means as in the form of a pillow which is not bulky or unsightly, and which is easily installed in a bass drum and retained therein in proper position for head dampening.

There is further need for an improved pillow means which, when installed in a bass drum, allows the drummer to feel the dampening effect during drumming and which also allows him to hear or note the muffling effect.

Finally, there is need for improved pillow means of different sizes readily installable within drums to be easily retained therein.

SUMMARY OF THE INVENTION

It is a major object of the invention to provide muffling apparatus meeting the above need or needs and which is otherwise easily formed and installed within the bass drums, as will appear.

Basically, the invention is embodied in muffling means installable in a bass drum having a curved side wall and two heads stretched or installed across opposite ends of the drum wall, such means comprising:

a) a pillow having longitudinally spaced opposite ends and length between the ends greater than the spacing between the heads, b) the pillow having lateral width which decreases away from each of the opposite ends toward the center of the pillow, c) the pillow having a surface which is outwardly and widthwise convex along the pillow width to engage the drum curved side wall at the inner side thereof, as the pillow is endwise compressed by engagement of the pillow opposite ends with the heads.

Another object is to provide such a pillow having laterally spaced sides, at least one of which has concave curvature along the longitudinal length of the pillow in that side. Typically, the other of the pillow sides also has concave curvature along the pillow length generally matching the first side curvature but facing opposite sidewardly; and as will be seen, the pillow typically has generally I-shaped configuration.

Yet another object is to provide the pillow with a surface which is outwardly and widthwise convex along the pillow length for engaging the bass drum internal curved side wall, which is concave, toward the pillow.

A further object is to provide resiliently yieldable holder means attaching the pillow to the drum side wall. As will be seen, such holder means may advantageously include multiple resiliently stretchable holders for holding the pillow in position adjacent the drum wall with the pillow ends compressively engaging the drum heads. One of such heads may contain an opening via which the I-shaped pillow may be easily inserted into the drum interior and manually fastened in position as by the holder means referred to.

These and other objects and advantages of the invention, as well as the details of an illustrative embodiment, will be more fully understood from the following specification and drawings, in which:

DRAWING DESCRIPTION

FIG. 3 is an enlarged plan view of an acoustic muffling pillow incorporating the invention;

FIG. 3*a* is a fragmentary side view taken on lines 3*a*—3*a* of FIG. 3;

FIG. 4 is a section taken on lines 4—4 of FIG. 3; and

Figure 1:
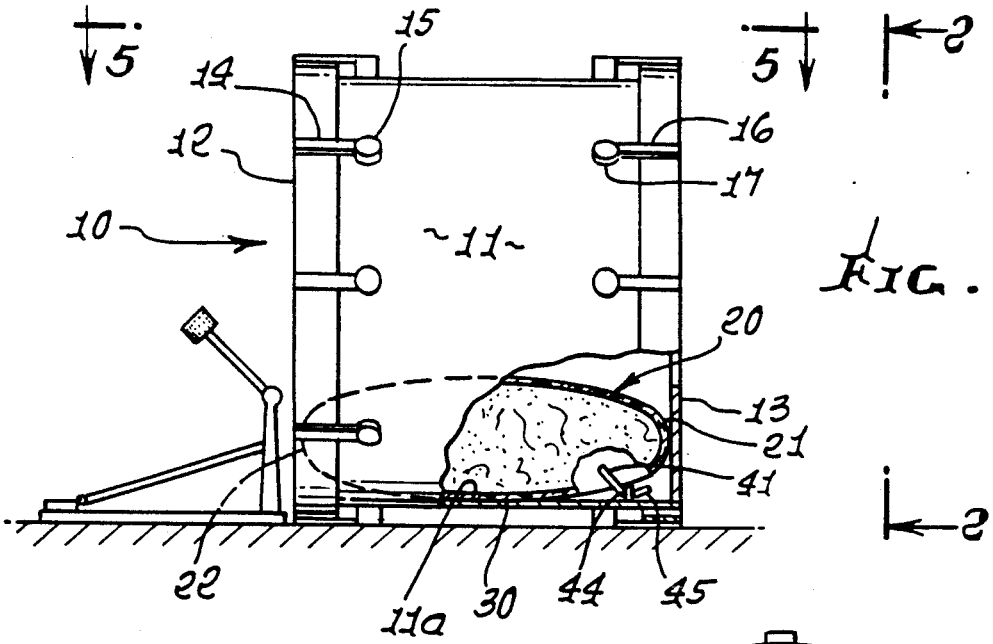
FIG. 1 is a side view of a bass drum within which the invention is incorporated.
Figure 5:
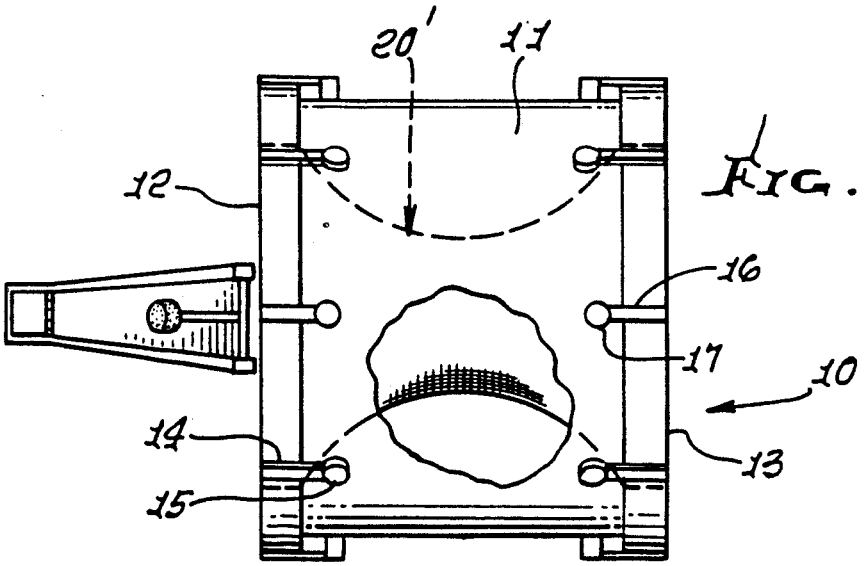

FIG. 5 is a top plan view of the FIG. 1 drum taken on lines 5—5 of FIG. 1.

DETAILED DESCRIPTION

In the drawings, a bass drum 10 has a curved, i.e., cylindrical, side wall 11 which is open at opposite ends. Drum heads 12 and 13 are attached to the opposite ends of the wall 11 to extend across open opposite ends of the drum wall. Head 12 extends completely across that end of the drum and is typically attached as by holder parts 14 and 15. Drum head 13 is annular, as better seen in FIG. 2; and its outer periphery 13*a* is attached to the wall 11 by circularly spaced holder parts 16 and 17 as is conventional. The head 13 defines an opening 18 to the drum interior via which the acoustic muffling pillow 20 may be inserted into the drum and/or removed therefrom. If head 13 has no opening 18, head removal is required to insert or remove the pillow.

Referring to FIGS. 3 and 4, the pillow 20 has longitudinally spaced opposite ends 21 and 22 which are laterally elongated to form ears 23 and 24. The opposite ends are curved as indicated in FIG. 3*a*, and laterally elongated, as referred to, to provide maximum contact with the drum heads, while allowing for lengthwise compressive deflection of the pillow, such compression assuring continued contact of the pillow opposite ends with the drum heads. Thus, the pillow, prior to its installation, has overall longitudinal length A, which is slightly greater than the longitudinal distance or spacing between the drum heads.

The pillow also has lateral width which decreases away from each of the opposite ends 21 and 22 toward the center region 25 of the pillow. For example, note that as seen in FIG. 3, at least one of the lateral sides 28 and 29, and preferably both of such sides, has or have concave curvature along the longitudinal length of the pillow. As shown, the concave sides face laterally oppositely. The pillow, therefore, has generally I-shaped configuration, and the compressive forces squeezing the pillow endwise between the drum heads are directed inwardly laterally as well as longitudinally to concentrate at the mid portion of the pillow having minimal width for desired acoustic dampening effect, as referred to above. See compression arrows 100 and 101.

Figure 2:
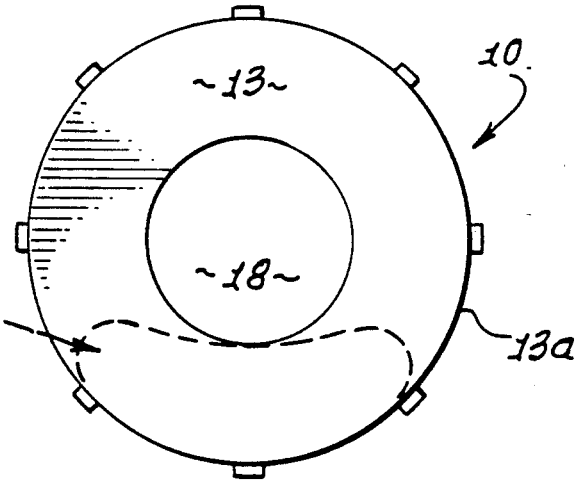
FIG. 2 is an end view of the FIG. 1 drum taken on lines 2—2 of FIG. 1.

FIGS. 1, 2 and 5 show the pillow installed within the drum, as for example indicated by broken lines 20' in FIG. 5. The pillow lower convex surface 30 faces toward and engages the upwardly concave inner side 11*a* of the drum wall 11, a nice fit being achieved for support of the pillow laterally and longitudinally in its lengthwise compressed condition. The pillow itself includes fabric cover 33 containing batting 34 filled into the cover, the batting being resiliently compressible.

Such batting typically may comprise Dacron polyester material, such as strips or small pieces.

Holder means is provided to hold or attach the pillow to the wall 11 in its installed position, as shown. Such holder means may include multiple, as for example four resiliently stretchable bands, typically elastic bands 41 connected to the tabs 42 integral with the pillow fabric cover 33 at locations 43 along the concave opposite sides of the pillow. The opposite ends of the bands 41 are removably attached to the drum wall as at tab locations 44. For this purpose, the ends of the elastic bands 41 may be provided with enlarged beads 45 which slip through the loop-shaped tabs 44 and are retained in virtue of the sizes of the beads. The bands extend toward the wall 11 at angles having components which are directed longitudinally of the pillow whereby the stretched bands assist in holding those ends 21 and 22 in engagement with the drum heads for desired muffling effect, and also in a simple, efficient manner to allow ease of installation of the pillow into the drum and its removal therefrom.

The pillow may be made in different sizes as per the following examples:

EXAMPLE 1

A is 26"
B is 20½"
C is 10½"
D is 2½", and
R (radius) is 13½"

EXAMPLE 2

A is 24"
p B is 20½"
C is 10"
D is 2½"
R is 11½"

The above dimensions are for an unfilled sleeve or sleeves. After filling with batting, the A dimension in Example 1 becomes 21", and the pillow thickness is about 5". After filling in Example 2, the A dimension becomes about 19". The Example 1 pillow is for an 18" drum; and the Example 2 pillow is for a 16" drum. The pillow fabric desirably consists of 100% cotton crinkle, black gauze for minimum external visibility, and the filling consists of Dacron polyester D91. The retention bands are typically black for minimum visibility.

We claim:

1. In a bass drum having a curved side wall and two heads, sound muffling means comprising in combination:

(a) a pillow having longitudinally spaced opposite ends and a longitudinal length between said ends greater than the spacing between said heads, (b) the pillow having lateral width which decreases away from each of said opposite ends toward the center of the pillow, (c) the pillow having a surface which is outwardly and widthwise convex along the pillow length to engage the drum curved side wall of the inner side thereof, as the pillow is endwise compressed by engagement of said pillow opposite ends with said heads, (d) he pillow having laterally spaced sides, having concave curvature along the longitudinal length of the pillow, whereby the pillow has generally I-shaped configuration, (e) and holder means including multiple resiliently yieldable holders holding the pillow against the drum wall, with said pillow ends compressively engaging the drum heads.

2. In combination with a bass drum having a curved side wall and two heads, sound muffling means comprising (a) a pillow having longitudinally spaced opposite ends, the pillow received in the drum with said pillow ends engaging said heads, the pillow having a length between said ends such that the pillow is slightly compressed between said heads, (b) the pillow having lateral width which decreases away from said ends, toward that portion of the pillow midway between said ends, (c) and including resiliently yieldable holder means attaching the pillow to the drum side wall, (d) and wherein one of said heads completely covers the drum interior at one end of the drum, and the other of said heads is annular at the opposite end of the drum and defines an opening via which the pillow is insertible into the drum.

3. The combination of claim 2 wherein the pillow has longitudinal length and laterally spaced opposite sides at least one of which has concave curvature along the longitudinal length of the pillow at said one side.

4. The combination of claim 3 wherein the other of said sides also has concave curvature along the longitudinal length of the pillow, at said other side.

5. The combination of claim 2 wherein the pillow has generally I-shaped configuration.

6. The combination of claim 4 wherein the pillow has generally I-shaped configuration.

7. The combination of claim 2 wherein said pillow includes a fabric cover, and polyester batting filled into said cover.

8. In combination with a bass drum having a curved side wall and two heads, sound muffling means comprising (a) a pillow having longitudinally spaced opposite ends, the pillow received in the drum with said pillow ends engaging said heads, the pillow having a length between said ends such that the pillow is slightly compressed between said heads, (b) the pillow having lateral width which decreases away from said ends, toward that portion of the pillow midway between said ends, (c) and including resiliently yieldable holder means attaching the pillow to the drum side wall, said holder means including elastic bands attached to portions of the pillow of decreasing width, relative to said opposite ends.

9. The combination of claim 8 wherein said holder means includes four holders attached to portions of said pillow which define said concave curvature, the pillow having enlarged opposite ends held in compressive engagement with said drum heads, by force exertion by said four holders which are tensioned, and anchored to the drum curved side wall, the pillow comprising a fabric cover containing batting material filled into the cover, the batting being resiliently compressible.

10. The pillow of claim 8 which has generally I-shaped configuration.

11. In combination with a bass drum having a curved side wall and two heads, sound muffling mans comprising (a) a pillow having longitudinally spaced opposite ends, the pillow received in the drum with said pillow ends engaging said heads, the pillow having a longitudinal length between said ends such that the pillow is slightly compressed between said heads, (b) the pillow having lateral width which decreases away from at least one of said ends, toward that portion of the pillow midway between said ends, (c) the pillow lateral width also decreasing from the other of said opposite ends toward said portion of the pillow midway between said ends, (d) the pillow having laterally spaced opposite sides at least one of which has concave curvature along the longitudinal length of the pillow at said one side, and wherein the other of said sides also has concave curvature along the longitudinal length of the pillow, at said other side, (e) the pillow having a surface which is outwardly and widthwise convex along the pillow longitudinal length and which engages the drum curved side wall which is concave toward the pillow.

12. The pillow of claim 11 which has generally I-shaped configuration.

* * * * *